United States Patent [19]

Ard et al.

[11] Patent Number: 4,726,310

[45] Date of Patent: Feb. 23, 1988

[54] BOAT HULL

[76] Inventors: Ernest E. Ard; Randall E. Ard, both of Rte. #1, Box 454, Cantonment, Fla. 32533

[21] Appl. No.: 887,556

[22] Filed: Jul. 17, 1986

[51] Int. Cl.[4] ..... B63B 1/20

[52] U.S. Cl. ..... 114/56; 114/290; 114/291

[58] Field of Search ..... 114/56, 288–291, 114/356–358; D12/300, 313, 314

[56] References Cited

U.S. PATENT DOCUMENTS

| | | | |
|---|---|---|---|
| Des. 244,518 | 5/1977 | Allison | D12/314 |
| 3,216,389 | 11/1965 | Thorsen | 114/56 |
| 4,233,920 | 11/1980 | Wood et al. | 114/56 |
| 4,361,102 | 11/1982 | Wood et al. | 114/56 |

*Primary Examiner*—Sherman D. Basinger
*Attorney, Agent, or Firm*—George A. Bode

[57] ABSTRACT

A deep vee entry hull having a central running surface extending fore and aft thereof, the cross-section thereof transitioning from a pronounced vee to a nearly planar configuration from fore to aft of the hull, the central running surface narrowing at its aft end portion and being flanked, in the after portion of the hull, by first and second inner running surfaces, intermediate running surfaces and outboard running surfaces, the first inner running surfaces being planar and exhibiting, with the central running surface, a vee configuration in cross-section; and the intermediate and outboard running surfaces exhibiting a cross-section of uninterrupted concave curvature commencing amidship to the extreme aft exit end thereof; the hull including sidewalls and the curvature of the concave intermediate and outboard running surfaces, at any given fore and aft positions, are constant, up to and including, an outer lip of said outboard running surfaces merging the same with the hull sidewalls; the intermediate and outboard running surfaces being planar in the forward portion of the hull and transitioning to the concave configuration amidship, and the depth of the concave configuration gradually increasing from amidship to stern.

20 Claims, 7 Drawing Figures

BOAT HULL

BACKGROUND OF THE INVENTION

1. Field of the Invention

This invention relates to open power boats of the type used in fishing and other recreational boating and, more particularly, to the hull configuration thereof.

2. General Background

In smaller vee entry boats rated for one hundred (100) h.p. but yet having top speeds in excess of fifty (50) mph, with which the invention is particularly concerned, the choice of hull configuration has conventionally involved various tradeoffs among the more desirable criteria, which includes safety and fuel economy on the one hand and high speed performance on the other. These tradeoffs are nowhere more evident in a conventional vee planing hull than in a sharp course correction from "full out" on plane running where, from the standpoint of safety, it is necessary to come substantially offspeed to achieve the increased wet planing area necessary for turn tracking stability. This, of course, produces a significant increase in drag with a concomitant decrease in fuel efficiency, both in the turning maneuver and bringing the boat back to full plane after the course correction. It is the purpose of this invention to resolve these conventional tradeoffs as related to high speed course correction.

High speed turns are one of the more dangerous boating maneuvers that are particularly unforgiving of the novice boater who has not mastered the feel for coordinating trim and throttle adjustments at the inception and execution of the turn. Indeed, it is a rare expert who, even when throttling back from top speed and entering a proper trim adjustment, has not felt unanticipated stern slippage or "chine walk".

The prudent boater thus comes drastically offspeed to execute a sharp turn. The decrease in speed, of course, results in a greater wetted area of the hull, puts more chines in the water, and most importantly, reduces the magnitude or arc of the layover angle which the outer running surface of the hull on the inside of the turn makes with the water surface. The consequence of the latter is that with the lesser arc of downward movement in a given time frame, the laying over of the outer running surface into wetting contact does not produce the violent slapping and bouncing from the surface that initiates repeated slapping impacts and violent stern slippage that is characteristic of a high speed turn under full throttle where the arc of descent is substantially greater from the full on-plane position.

The foregoing is a typical performance of conventional vee hulls having the usual planar running surfaces, separated by chines, on either side of the keel line running surface which lateral, planar running surfaces and the central keel line running surface, when viewed in transverse section adjacent the aft end of the boat, exhibits a typical V-shape terminating laterally at outer chines continuous with the sides of the boat.

As related to the present invention, it is important to note that prior art hulls of the type herein comtemplated have employed planar outboard running surfaces to more easily "slip" the water and avoid low speed cavitation.

A typical high performance type hull configuration is shown in U.S. Pat. No. 4,465,009, where high speed turning characteristics are increased by the use of after, outboard running surfaces which are concavely configured.

Another typical hull configuration, such as shown in U.S. Pat. No. 3,216,389, where all the running surfaces are concave, is distinguishable in kind from high performance type hulls such as described in U.S. Pat. No. 4,465,009 since inherent hull cavitation over the entire speed range of such a boat is inconsistent with the purposes therein, which is directed to performance parameters in that speed range beyond the reach of such atypical hulls.

SUMMARY OF THE PRESENT INVENTION

A deep vee entry hull tapers gradually aft to a more flattened V-shape amidship and transitions rearward therefor to terminate in a modified gull wing appearance viewed in cross-section as a consequence of the intermediate and outer running surfaces being slightly concavely configured in the after portions thereof, the outer running surfaces being of a lesser curvature than the intermediate running surfaces. The result is that in the after portion of the hull, the lateral outmost portions of the hull extend well below a straight line extrapolation of the midportion of the aft hull configuration defined by the central keel running surface and the planar inboard running surfaces.

The outermost portions of the intermediate and outer concave running surfaces at the aft end of the hull, therefore, have a lesser clearence above the water line on-plane and make wetted contact early on in a turning maneuver after moving through a lesser layover arc than is the case with a conventional vee hull. This initial wetting contact is one of gradually increasing resistance as the turn is tightened rather than an immediate impact along a broad planar surface so that the tendency to "chine walk" or skid is reduced as a function of the shape and relationship of the concavities of the surfaces. In addition to reducing impact bounce, the concave running surfaces on the inside of the turn funnel outflowing water smoothly away from the central portion of the hull and impart a downward component to the lateral outflow which produces an upward turn stabilizing force on the stern at the inside of the turn making it possible to dispense with the use of wedges to control "porpoising" since, in a small, low horsepower boat with which the invention is concerned, the additional drag imposed by after-wedges defeats the ability of the 115 h.p. propulsion unit to maintain speeds in excess of 50 mph in a turn. As the turn is further tightened to maximum, the increasing submergence of the concave running surfaces produce a more than linear increased resistance to stern skid as a function of the greater reach and shape of the concave running surfaces "digging in" as compared with a conventional planar running surface. Since these turning maneuvers involve, in effect, a yawing movement of the boat initiated from the stern, it is essential that the bow of the boat present minimal resistance to such movement which explains the necessity for transitioning the intermediate and outer running surfaces from planar forward to concave aft with the transition being effected approximately amidship.

The central running surface terminates aft in a "wishbone" shape. The result funnels water straight down, into the propellor aft so that the propellor can obtain a "good hold" allowing increased lift of the hull (the hull "sits up") so that it can run and turn without stern slippage.

A central recessed portion of the lower stern providing an inverted "step" moves the balance point forward and allows increased lift of the hull so that it can run and turn without stern slippage.

Concave depressions in the stern extend from either side of the step outwardly and upwardly therefrom to the sidewalls. The depth of the depressions (measured from the stern forward) increase gradually from the step outwardly to the sidewalls and from the top to the bottom of the transom. The result is that the boat can run and turn without stern slippage.

The maneuverability and, particularly, the turning capabilities of the hull herein disclosed are truly astounding. Production models of the present hull design are routinely put through 50 mph 360° turns without throttle or trim adjustments. "Chine walk" on turns is virtually eliminated.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
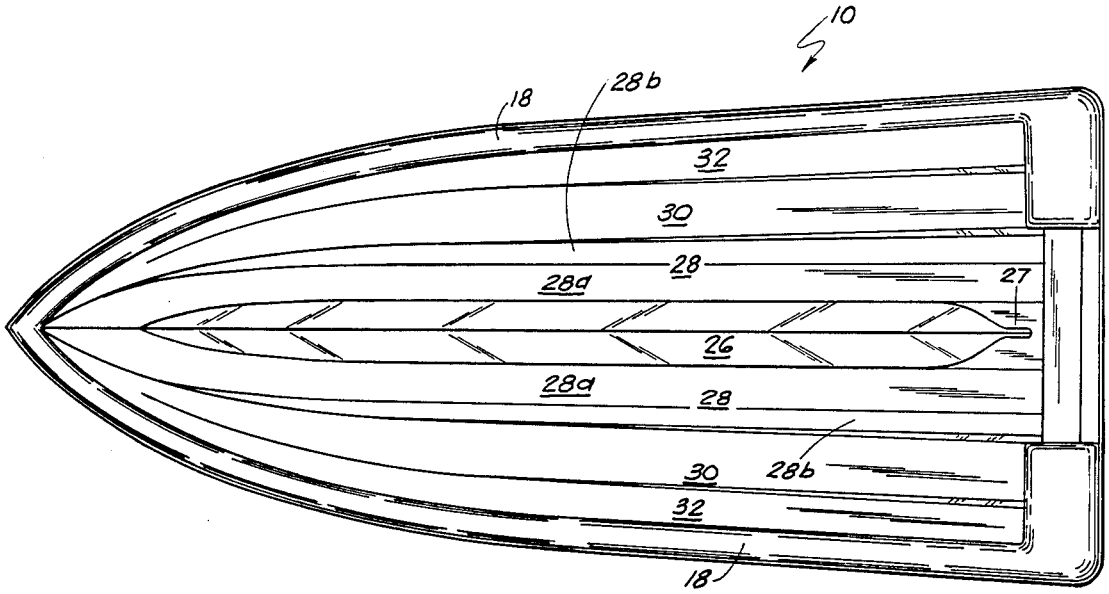
FIG. 1 is a top plan view of a boat hull of the present invention.

In FIGS. 1–7, is illustrated an open power boat hull 10 for a boat adapated to be driven by an outboard propulsion unit (not shown) mounted to transom 12, including a deck portion 14 surmounting the novel deep vee entry hull 10, which is the subject matter of the present invention.

The purpose of the novel hull construction is to facilitate high speed running and turning maneuvers.

Hull 10 includes sidewalls 19, having lower sidewalls 17 and upper sidewalls 18 which are integrally joined by lips (aft) or spray rails (forward) 20 extending forward from immediately adjacent the stern to terminate at the bow immediately adjacent the gunwale. The undersurface of hull 10 includes central and outboard chine pairs 22, 24 extending forward from the stern to terminate short of the bow.

Figure 2:
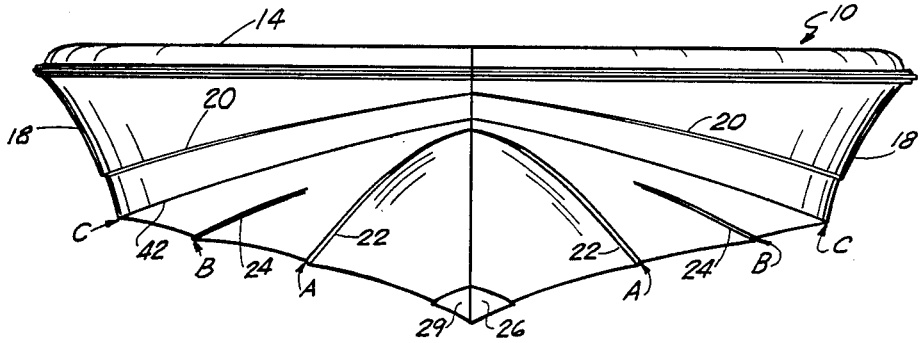
FIG. 2 is a front elevation of the boat hull of FIG. 1.
Figure 5:
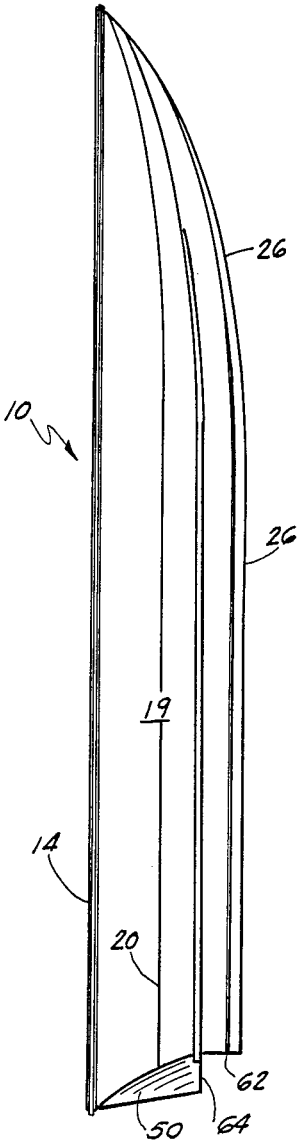
FIG. 5 is a side elevation of the boat hull of FIG. 1, the opposite side being a mirror of that shown.
Figure 4:
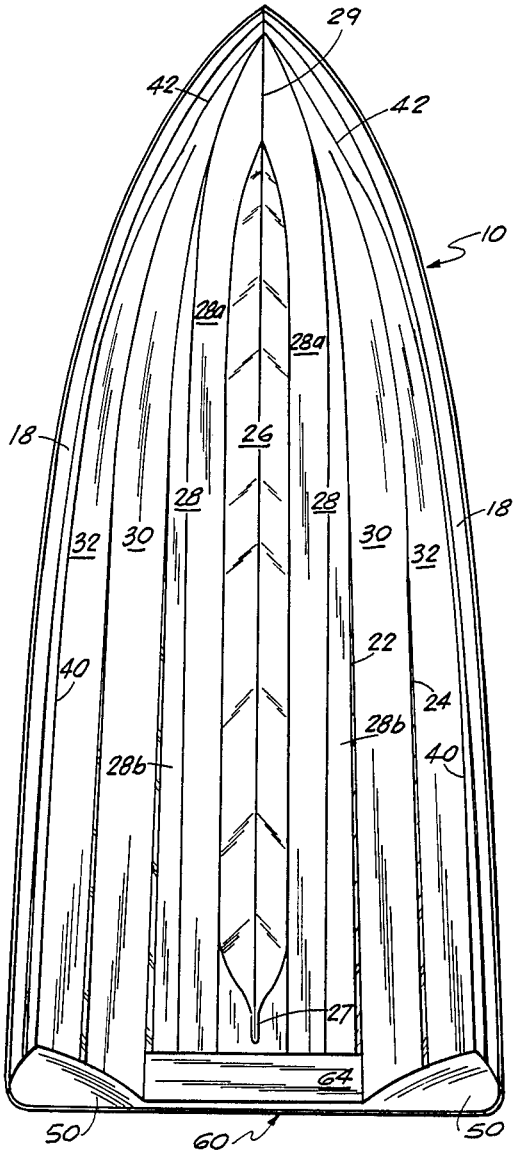
FIG. 4 is a bottom plan view of the boat hull of FIG. 1.

The deep vee entry portion of the hull is best shown in FIG. 2, while the gradual flattening of the vee configuration moving from bow to stern, is best seen in FIG. 5.

Figure 3:
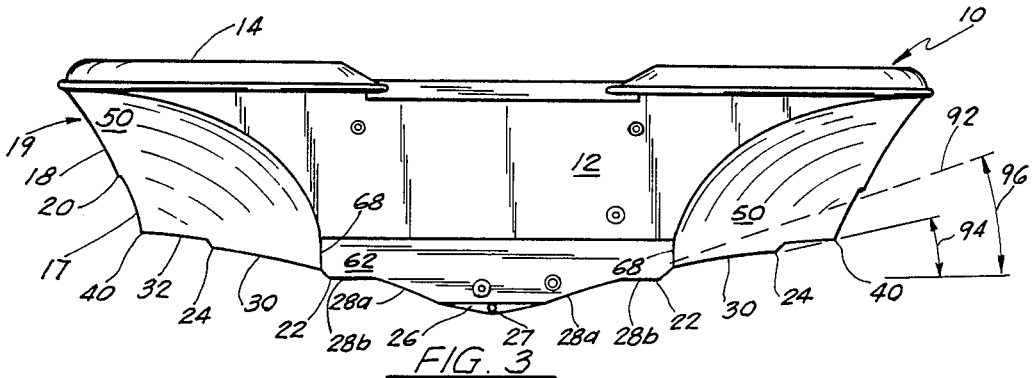
FIG. 3 is a rear elevation of the boat hull of FIG. 1.
Figure 7:
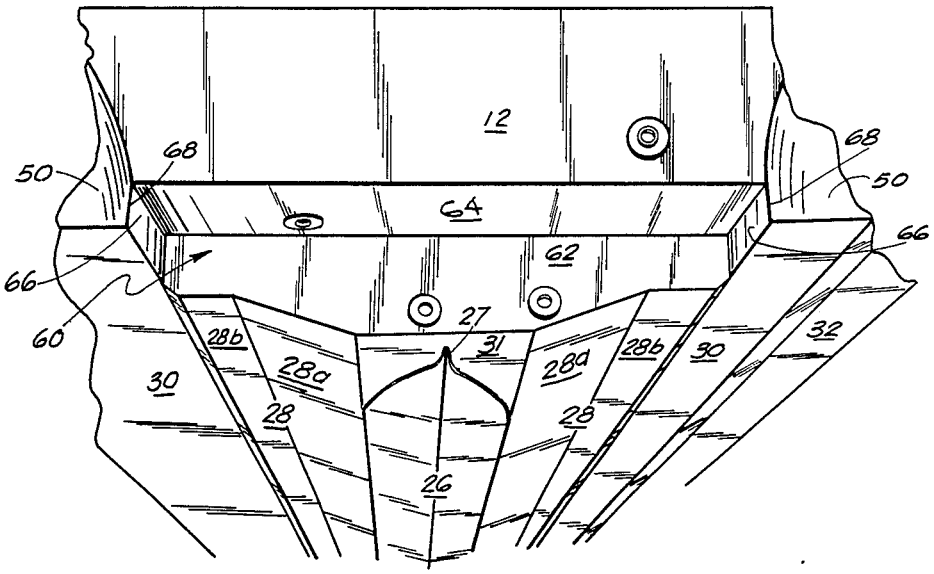
FIG. 7 is an enlarged partial rear perspective view of the boat hull of FIG. 1.
Figure 6:
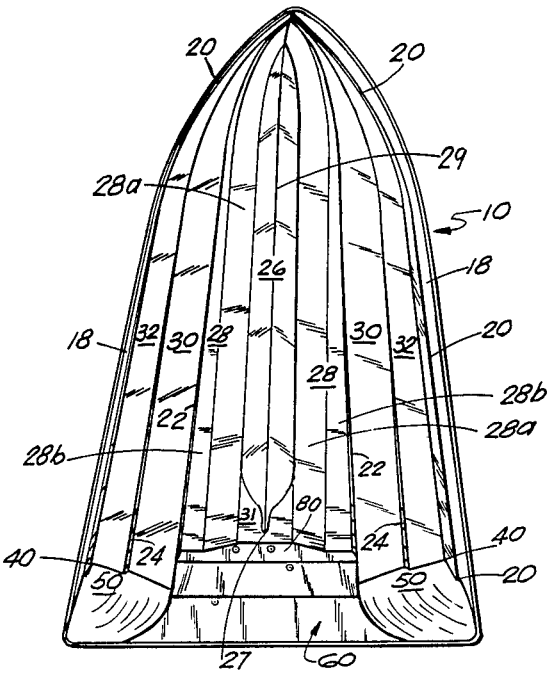
FIG. 6 is a bottom perspective view of the boat hull of FIG. 1.

The after centerline keel portion, or central running surface, 26 is flanked by first and second planar inner running surfaces **28*a* and 28*b* respectively from inboard to outboard delimited outboard by chine pairs 22 and intermediate running surfaces 30 respectively delimited outboard by chine pairs 24. As best seen in FIGS. 3, 6 and 7, first and second inner running surfaces 28*a*, 28*b* form an obtuse angle, with second inner running surfaces 28*b* being substantially planar as raised surface area 31. The intermediate running surfaces 30 and outboard running surfaces 32, which play an important role in the present invention, are formed by being planar in the forward portion (between POINTS A and B and POINTS B and C of FIG. 2) and then with a gradually increasing slight concavity from amidship aft (the curvature of intermediate running surfaces 30 being greater than the curvature of outboard running surfaces 32, but the length of the arcs formed by running surfaces 30 being greater than the length of the arcs formed by running surfaces 32), the maximum being exhibited at the stern where, from FIG. 3, it will be seen that the generally V-shaped cross-section has transitioned to a modified gull wing shape due to the presence of the concave running surfaces 30, 32 outboard of planar second inner running surfaces 28*b*. This "gull wing" appearance is a sharp contrast with the stern appearance of the conventional vee hull whose outer planar running surfaces comprise a straight line extrapolation of the first inboard planar running surfaces 28*a* as indicated by the phantom line 92 in FIG. 3. It will be seen that not only is the arc 94 of the "gull wing" layover angle substantially less than the arc 96** of the conventional layover angle, but the result of the concave shapes is to enter the water, on turn, with a gradually increasing resistance thus avoiding the instantaneous rebound producing slap or impact associated with outer planar running surfaces. The result is substantial elimination of "chine walk" as yaw torquing moment is gradually increased upon tightening of the turn as a function of the outboard edge of the concave running surface "digging in" which latter "digging in" description is defeated by conventional slapping rebound.

It will be noted that the outer running surfaces 32 terminate outboard in the after position of the hull, as best seen in FIG. 3, in a smooth continuation of the concave configuration rather than terminating at an abrupt chine line as is conventional, although it will be also noted that the forward outboard running surfaces 32 and forward planar portions thereof terminate outboard in the usual chine 42 which extends from a merger amidship with lip 40 of outer running surface 32 forwardly to the bow. While it is clear that the function of bow chines 42, at least along the wetted portions thereof in a slow speed mode, are conventional; it is not fully understood just why its aft termination, where the concave portion of outboard running surfaces 32 commence, is important, but tests have confirmed this fact. It is hypothesized that the more abrupt downward curvature is produced by a chine, the outboard lip 40 of running surface 32 at the aft end thereof produces lifting torque on the inside of high speed turns and is consistent with the desired submergence rate of the outer lip 40 as the turn is tightened.

As best seen in FIGS. 1, 4, 6 and 7, central running surface 26 terminates aft short of the stern (and short of recess 60, to be discussed further herein) in a "wishbone" shape providing a "tail" portion 27 and raised surface area 31, area 31 being the complement to tail portion 27. Central running surface 26 terminates short of the bow in rib 29. The result funnels water straight down, into the propellor aft so that the propellor can obtain a "good hold" allowing increased lift of the hull (the hull "sits up") so that it can run and turn without stern slippage.

As best seen in FIGS. 4–7, and particularly FIG. 7, an inverted step or recess 60 is provided in the lower central portion of the stern of hull 10. Inverted step or recess 60 comprises rear wall 62 (which is the terminus of central running surface 26 and inner running surface 28) side walls 66 and roof 64, thus forming the rectangular recess best seen in FIG. 7. The result is moving the balance point forward and thereby allowing increased lift of the hull so that it can run and turn without stern slippage.

As best seen in FIGS. 3–7, concave depressions 50 formed in the stern of hull 10 extend from either side edge 68 of recess 60 outwardly and upwardly therefrom to the respective sidewalls 19 formed by lower and upper sidewalls 17, 18. The depth (measured from the stern forward) of depressions 50 increases gradually from edge 68 of recess 60 outwardly to sidewalls 19 and from the top (near deck 14) to the bottom (at the rear edges of running surfaces 30, 32) of the stern. The result is allowing the boat to run and turn without stern slippage.

Because many varying and differing embodiments may be made within the scope of the inventive concept herein taught, and because many modifications may be made in the embodiment herein detailed in accordance with the descriptive requirement of the law, it is to be understood that the details herein are to be interpreted as illustrative and not in a limiting sense.

What is claimed as invention is:

1. A deep vee entry hull having a central running surface extending fore and aft thereof, the cross-section thereof transitioning from a pronounced vee to a nearly planar configuration from fore to aft of said hull, said central running surface narrowing at its aft end portion and being flanked, in the after portion of the hull, by first and second inner running surfaces, intermediate running surfaces and outboard running surfaces, said first inner running surfaces being planar and exhibiting, with said central running surface, a vee configuration in cross-section; and said intermediate and outboard running surfaces exhibiting a cross-section of uninterrupted concave curvature commencing amidship to the extreme aft exit end thereof; said hull including sidewalls and the curvature of said concave intermediate and outboard running surfaces, at any given fore and aft position, are constant, up to and including, an outer lip of said outboard running surfaces merging the same with the hull sidewalls; said intermediate and outboard running surfaces being planar in the forward portion of the hull and transitioning to said concave configuration amidship, and the depth of said concave configuration gradually increasing from amidship to stern.

2. The hull of claim 1, including outboard bow chains extending aft from the bow of said hull and merging amidship with the outer lips of said outboard concave running surfaces.

3. The hull of claim 2, wherein said deep vee entry hull tapers aft to a more flattened shape amidship and transitions rearwardly thereof to terminate in a modified gull wing appearance in cross-section as a function of said concave intermediate and outboard running surfaces.

4. The hull of claim 1, wherein said intermediate running surfaces have a concavity greater than said outboard running surfaces.

5. The hull of claim 4, wherein said intermediate running surfaces have an arc of a length greater than the length of the arc of said outboard running surfaces.

6. The hull of claim 1, further comprising a recess provided centrally in the lower stern of said hull.

7. The hull of claim 6, wherein said central running surface terminates in said narrow aft portion spaced from said recess.

8. The hull of claim 6, wherein said stern is provided with concave depressions therein, said depressions extendinging outwardly and upwardly from the side edges of said recess to the sidewalls of said hull.

9. The hull of claim 8, wherein said depressions are of a depth, from said stern forward, gradually increasing from said edges of said recess to said sidewalls and from the top to the bottom of said stern.

10. A deep vee entry hull comprising:

(a) a central running surface extending fore and aft of said hull, the cross-section thereof traansitioning from a pronounced vee to a nearly planar configuration from fore to aft and narrowing at its aft end portion;

(b) sidewalls;

(c) first and second inner running surfaces flanking said central running surface, in the after portion of the hull, and said first inner running surfaces being planar and exhibiting, with said central running surface, a vee configuration in cross-section;

(d) intermediate running surfaces flanking said central running surface in the after portion of the hull, exhibiting a cross section of uninterrupted concave curvature commencing amidship to the extreme aft exit end thereof; and (e) outboard running surfaces flanking said central running surface in the after portion of said hull and exhibiting a cross-section of uninterrupted concave curvature commencing amidhsip to the extreme aft exit end thereof, the curvature of said concave outboard running surfaces, at any given fore and aft position, constant up to and including an outer lip merging the same with the hull sidewalls, said outboard running surfaces being planar in the forward position of the hull and transitioning to said concave configuration amidship, and the depth of said concave configuration gradually increasing from amidship to stern.

11. The hull of claim 10, including outward bow chines extending aft from the bow of said hull and merging amidship with the outer lips of said outboard concave running surfaces.

12. The hull of claim 11, wherein said deep vee entry hull tapers aft to a more flattened shape amidship and transitions rearwardly thereof to terminate in a modified gull wing appearance in cross-section as a function of said concave intermediate and outboard running surfaces.

13. The hull of claim 10, wherein said intermediate running surfaces have a concavity greater than said outboard running surfaces.

14. The hull of claim 13, wherein said intermediate running surfaces have an arc of a length greater than the length of the arc of said outboard running surfaces.

15. The hull of claim 10, further comprising a recess provided centrally in the lower stern of said hull.

16. The hull of claim 15, wherein said central running surface terminates in said narrow aft portion spaced from said recess.

17. The hull of claim 15, wherein said stern is provided with concave depressions therein, said depressions extending outwardly and upwardly from the side edges of said recess to the sidewalls of said hull.

18. The hull of claim 17, wherein said depressions are of a depth, from said stern forward, gradually increasing from said edges of said recess to said sidewalls and from the top to the bottom of said stern.

19. A deep vee entry hull comprising:

(a) a central running surface extending fore and aft of said hull, the cross-section thereof transitioning from a pronounced vee to a nearly planar configuration from fore to aft and narrowing at its aft end portion;

(b) sidewalls;

(c) a recess provided centrally in the lower stern of said hull;

(d) first and second inner running surfaces flanking said central running surface, in the after portion of the hull, and said first inner running surfaces being planar and exhibiting, with said central running surface, a vee configuration in cross-section;

(e) intermediate running surfaces flanking said central running surface in the after portion of the hull, exhibiting a cross section of uninterrupted concave curvature commencing amidship to the extreme aft exit end thereof;

(f) outboard running surfaces flanking said central running surface in the after portion of said hull and exhibiting a cross-section of uninterrupted concave curvature commencing amidship to the extreme aft exit end thereof, the curvature of said concave outboard running surfaces, at any given fore and aft position, being less than the concavity of said intermediate running surfaces, constant up to and including an outer lip merging the same with the hull sidewalls, said outboard running surfaces being planar in the forward position of the hull and transitioning to said concave configuration amidship, and the depth of said concave configuration gradually increasing from amidship to stern; and (g) concave depressions provided in said stern, said depressions extending outwardly of and upwardly from the side edges of said recess to the sidewalls of said hull and of a depth, from said stern forward, gradually increasing from said edges of said recess to said sidewalls and from the top to the bottom of said stern.

20. The hull of claim 19, including outward bow chines extending aft from the bow of said hull and merging amidship with the outer lips of said outboard concave running surfaces and wherein said deep vee entry hull tapers aft to a more flattened shape amidship and transitions rearwardly thereof to terminate in a modified gull wing appearance in cross-section as a function of said concave intermediate and outboard running surfaces.

* * * * *